US006806656B2

(12) United States Patent
Rahman

(10) Patent No.: US 6,806,656 B2
(45) Date of Patent: Oct. 19, 2004

(54) FUSE BULB TWINKLE LIGHT SET

(75) Inventor: Najeh Rahman, Harriman, NY (US)

(73) Assignee: Sienna LLC, Oakland, NJ (US)

( * ) Notice: Subject to any disclaimer, the term of this patent is extended or adjusted under 35 U.S.C. 154(b) by 5 days.

(21) Appl. No.: 10/320,158

(22) Filed: Dec. 16, 2002

(65) Prior Publication Data

US 2004/0113562 A1 Jun. 17, 2004

(51) Int. Cl.[7] ..... H05B 37/00; F21S 13/14
(52) U.S. Cl. ..... 315/185 R; 362/236; 362/252
(58) Field of Search ..... 315/185 R, 189, 315/185 S, 200 A; 362/234, 236, 238, 252, 253

(56) References Cited

U.S. PATENT DOCUMENTS

| | | | | | |
|---|---|---|---|---|---|
| 3,723,723 | A | * | 3/1973 | Lerner | 362/251 |
| 3,864,598 | A | | 2/1975 | Cardwell, Jr. | 315/74 |
| 3,946,244 | A | * | 3/1976 | Davis, Jr. | 307/31 |
| 4,223,248 | A | | 9/1980 | Tong | 315/185 S |
| 4,227,228 | A | | 10/1980 | Cheng | 361/104 |
| 4,980,608 | A | * | 12/1990 | Morrison | 315/185 S |
| 5,205,769 | A | | 4/1993 | Mahonski et al. | 445/27 |
| 5,749,646 | A | * | 5/1998 | Brittell | 362/231 |
| 5,828,183 | A | * | 10/1998 | Wang et al. | 315/185 S |
| 5,969,469 | A | * | 10/1999 | Wang | 313/318.1 |
| 5,975,717 | A | * | 11/1999 | Rahman | 362/251 |
| 6,086,222 | A | * | 7/2000 | Juba et al. | 363/251 |
| 6,224,415 | B1 | | 5/2001 | Gibboney, Jr. | 445/27 |
| 6,257,740 | B1 | | 7/2001 | Gibboney, Jr. | 439/356 |
| 6,474,841 | B1 | | 11/2002 | Rahman | 362/252 |
| 6,580,182 | B2 | * | 6/2003 | Janning | 307/36 |

OTHER PUBLICATIONS

GE String–A–Long Box (non–twinkle light set, sold about Jul. of 2002).

* cited by examiner

*Primary Examiner*—Thuy Vinh Tran
(74) *Attorney, Agent, or Firm*—Amster, Rothstein & Ebenstein

(57) ABSTRACT

A twinkle bulb light set includes, alternately from one end of the light set to an opposite end of the light set, a plurality of standard bulb sockets, each configured and dimensioned to operatively receive a standard bulb, whether a steady burning bulb or twinkle bulb, and at least one fuse bulb socket configured and dimensioned to operatively receive a fuse bulb. The standard bulb sockets are configured and dimensioned to releasably operatively receive only standard bulbs, and the fuse bulb socket is configured and dimensioned to non-releasably operatively receive a fuse bulb.

37 Claims, 11 Drawing Sheets

FIG. 7
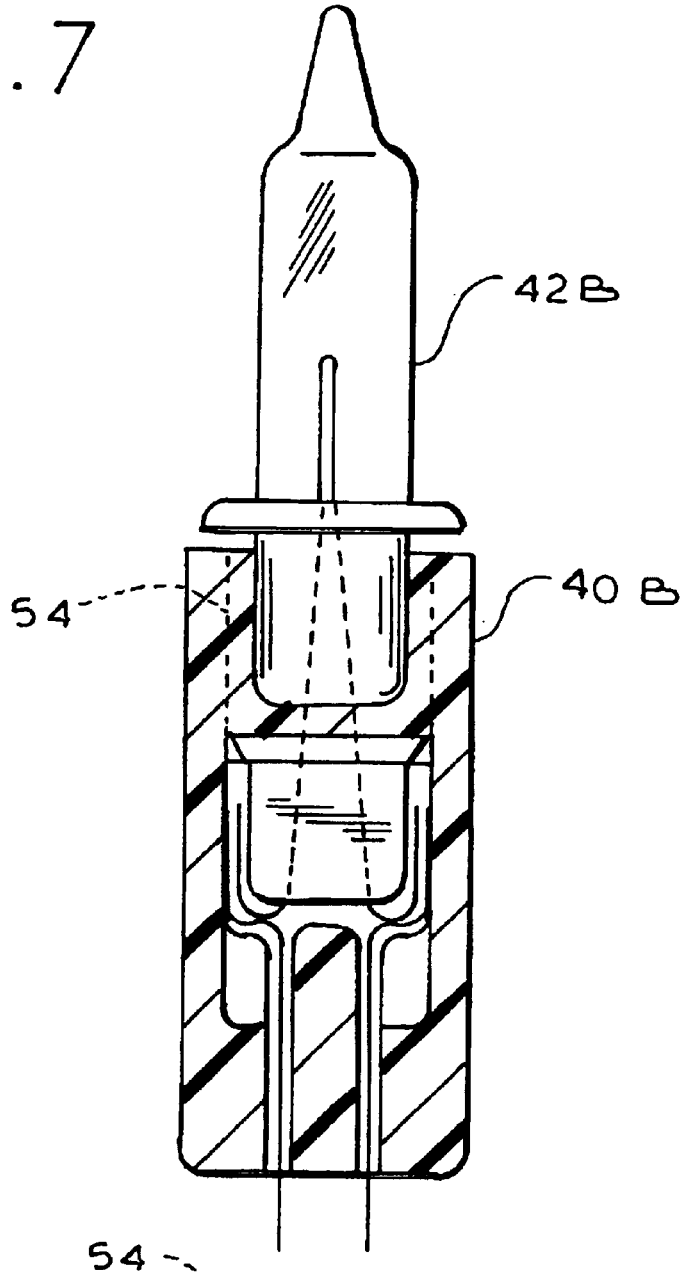
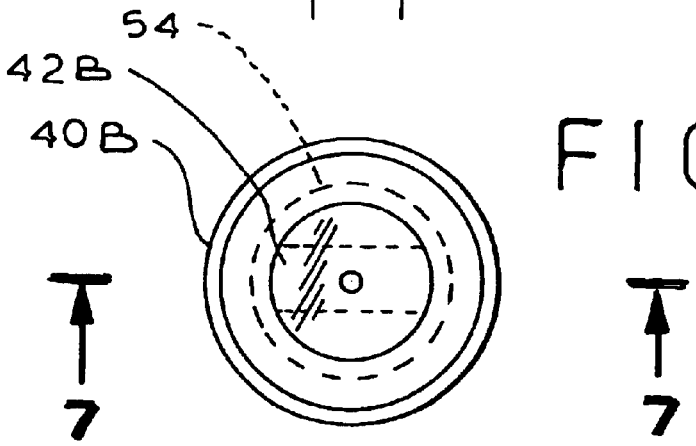
FIG. 6

FUSE BULB TWINKLE LIGHT SET

BACKGROUND OF THE INVENTION

The present invention relates to a twinkle light set, and more particularly to a fuse bulb twinkle light set which meets the safety objectives of the Underwriters Laboratory (UL) standards for safety.

UL Standard 588 distinguishes between the flasher bulb (LAMP, FLASHING) and the twinkle bulb (LAMP, INDIVIDUAL FLASHING) as follows:

5.16 LAMP, FLASHING—A series-or parallel-connected lamp that automatically cycles on and off by means of a bimetallic strip connected in series with the filament. For series-connected strings, the flashing lamp causes all lamps connected in series with it to flash. For parallel-connected strings, only the flashing lamp is intended to flash.

5.17 LAMP, INDIVIDUAL-FLASHING—A series-connected lamp that automatically cycles on and off by means of a bimetallic strip connected in parallel with the filament. The cycling of the bimetallic strip causes only the individual-flashing lamp to flash by momentarily placing a short across the filament to turn the lamp on and off.

It is well-known to provide a flasher light set wherein a flasher bulb (according to "5.16 LAMP, FLASHING") contains a thermally sensitive element which opens and closes the electrical illumination circuit through the bulb according to its "hot" or "cold" state. When the circuit containing the thermally sensitive element opens, there is no electricity supplied to any other bulb in series electrical communication therewith, so that each such series-connected bulb is temporarily extinguished until the element cools and the circuit again closes. Thus, use of even a single flasher bulb causes an entire light set or a section thereof in series communication to have its bulbs flash on and off with the flasher bulb. The appearance of a light set in which all of the bulbs or a section of the bulbs flashes on and off in unison presents an aesthetic attraction to a viewer.

However, an even more appealing aesthetic effect is produced by a twinkle light set. Instead of a flasher bulb, the twinkle light set uses a twinkle bulb (according to "5.17 LAMP, INDIVIDUAL-FLASHING"). The twinkle bulb is similar to the flasher bulb in that a thermally sensitive element opens and closes the electrical illumination circuit which provides illumination of the bulb. However, whereas in the flasher light set no current passes through the bulb when the illumination circuit through the bulb is open, in the twinkle light set, each twinkle bulb has in parallel with the illumination filament a bypass or shorting circuit. The bypass circuit (when closed) presents a low resistance, whereas the illuminating circuit (when closed) presents a high resistance. As the twinkle bulb is illuminated through the illumination circuit, it heats up the normally open switch in the bypass circuit, thereby to close the switch and provide an alternative low resistance path through which the current will preferentially flow. This in turn terminates substantially all of the current passing through the high resistance illumination circuit and leads to cooling of the bulb. After a predetermined amount of cooling, the switch in the bypass circuit returns to its normally open state so that current must flow once again through the illumination circuit.

One major difference between a twinkle light set and a flasher light set is that each twinkle bulb acts independently of the other twinkle or standard bulbs in series therewith because the twinkle bulb always passes current therethrough (whether through the illumination circuit or through the bypass circuit). Thus, in a twinkle light set, a wide variety of aesthetic effects may be obtained dependent upon the placement of the twinkle bulbs. For example, a twinkle light set may consist of a plurality of substantially vertical light strings, with each bulb in a given light string being in series. A set of light strings (at least one light string being in each light string set) may contain only ordinary or standard steady burning bulbs, while an alternate set of light strings (at least one light string being in each light string set) may contain only twinkle bulbs. The standard bulbs remain on constantly, while the twinkle bulbs twinkle on and off independently of each other, seemingly at random, as a counterpoint to provide an enhanced aesthetic appearance. Clearly any given light string(s) may include both standard and twinkle bulbs for providing a more startling aesthetic experience.

In a conventional twinkle light set typically a large or major proportion of the bulbs (at least 50% thereof) are ordinary or standard steady burning bulbs. Thus, even if all of the illumination circuits of all of the twinkle bulbs were, through happenstance, to open at the same time, so that each of the twinkle bulbs presented only the low resistance bypass path to the current, the standard bulbs (with their high resistance illumination circuits) would dissipate the current sufficiently to ensure safety of the light set and prevent a dangerous burn-out.

However, it is known that some twinkle light set users prefer for aesthetic reasons to modify the purchased twinkle light set and convert it to an exclusively twinkle bulb light set by replacing each standard bulb of the light set with a twinkle bulb. As a result, when, by happenstance, all of the illumination circuits of all of the twinkle bulbs are open, the current passes substantially unchecked and undiminished through the low resistance bypass circuits in a decidedly unsafe manner which can lead to melting of conductors, burning of insulation, fires, and the like. While twinkle light sets are usually sold with instructions cautioning against the replacement of standard bulbs with twinkle bulbs, users do not always heed this caution.

Accordingly, recently enacted Underwriters Laboratory (UL) regulations, Section 588, requires that a series-wired twinkle light set have a minimum of 35 (thirty five) bulbs per circuit (to minimize the current passing through any given bulb) and that at least eighteen of 35 (thirty five) bulbs be standard steady burning bulbs (as opposed to non-standard twinkle bulbs). This ensures that in each circuit of a series-wired twinkle light set there are an adequate number of ordinary bulbs to dissipate the current, even if by happenstance all of the twinkle bulbs are passing the current through the low resistance bypass circuits rather than the high resistance illumination circuits.

Commonly owned U.S. Pat. No. 6,474,841 describes a twinkle light set which meets the UL requirements by providing a plurality of standard bulb sockets which can operatively receive only a standard bulb (e.g., a conventional steady burning bulb or a flasher bulb) and a plurality of non-standard bulb sockets which can operatively receive a non-standard twinkle bulb or optionally a standard bulb. Thus, by limiting the number of non-standard bulb sockets, the manufacturer limits the number of twinkle bulbs which can be used in the light set.

Notwithstanding the safety of the twinkle light set according to the above patent, there are those who prefer relying on a fuse or fuse bulb such as that disclosed in U.S. Pat. No. 4,223,248. Fuse bulbs are well-known and, when properly used, clearly meet the safety objectives of the UL standards.

However, this requires that the fuse bulb either be non-removable from the fuse bulb socket or, if removable, be replaceable only a like fuse bulb. Clearly the entire purpose of having a fuse bulb would be defeated if a blown fuse bulb could be replaced by a non-fuse bulb such as a steady burning bulb, a flasher bulb or a twinkle bulb since none of these alternative bulbs would protect against excessive current in the circuit.

Accordingly, it is an object of the present invention to provide a twinkle light set which in one preferred embodiment meets the safety objectives of the UL standards, and in particular Section 588 thereof, without regard to the relative numbers of standard and twinkle bulbs in an electrical circuit.

Another object is to provide such a twinkle light set which in one preferred embodiment includes a fuse bulb socket which non-releasably operatively receives a fuse bulb.

A further object is to provide such a light set which in one preferred embodiment includes a non-standard fuse bulb socket which operatively receives a non-standard fuse bulb and cannot operatively receive a standard bulb.

Yet another object is to provide a twinkle light set which meets the safety objectives of the UL standards, and in particular Section 588 thereof, and provides dual levels of protection.

It is also an object to provide such a light set which in one preferred embodiment is simple and economical to manufacture, use and maintain.

SUMMARY OF THE INVENTION

It has now been found that the above and related objects of the present invention are obtained in three embodiments of a fuse bulb twinkle light set.

A first preferred embodiment of the present invention encompasses a fuse bulb twinkle light set comprising, for at least one electrical circuit including at least one conventional twinkle bulb, a single fuse bulb socket operatively receiving a fuse bulb and a plurality of standard bulb sockets, each of the latter operatively receiving a standard bulb, whether a conventional steady burning bulb or a conventional twinkle bulb. The standard bulb sockets are configured and dimensioned to releasably operatively receive standard bulbs, and the fuse bulb socket is configured and dimensioned to non-releasably operatively receive a fuse bulb.

In a preferred embodiment thereof, alternatively, the fuse bulb socket is secured by an adhesive to a fuse bulb, the fuse bulb socket is integrally molded to a fuse bulb, or the interior of the fuse bulb socket is at least temporarily deformed in at least one dimension by insertion of a fuse bulb therein such that the fuse bulb cannot thereafter be removed from the fuse bulb socket. In the last alternative, preferably the fuse bulb socket interior is smaller in the at least one dimension than the standard bulb socket interior. Thus, the twinkle light set comprises, for at least one electrical circuit including at least one conventional twinkle bulb, alternately from one end of the circuit to an opposite end of the circuit, a single fuse bulb socket non-releasably operatively receiving a fuse bulb, and a plurality of standard bulb sockets, each of the latter releasably operatively receiving a standard bulb, whether a conventional steady burning bulb or a conventional twinkle bulb.

The present invention extends to a combination of the twinkle light set, a fuse bulb, and a plurality of standard bulbs including at least one conventional twinkle bulb. The exterior of each of the standard bulbs is sized differently in at least one dimension than the exterior of the fuse bulb such that the fuse bulb cannot be removed from the fuse bulb socket interior. Preferably, the interior of the fuse bulb socket is at least temporarily deformed in at least one dimension by insertion of the fuse bulb therein such that the fuse bulb cannot thereafter be removed from the fuse bulb socket, the standard bulbs being smaller in the at least one dimension than the fuse bulb.

A second preferred embodiment of the present invention encompasses a fuse bulb twinkle light set comprising, for at least one electrical circuit including at least one conventional twinkle bulb, a single non-standard fuse bulb socket operatively receiving a non-standard fuse bulb, and a plurality of standard bulb sockets, each operatively receiving a standard bulb, whether a conventional steady burning bulb or a conventional twinkle bulb. The standard bulb sockets and the non-standard fuse bulb socket are configured and dimensioned to operatively receive only standard bulbs and a non-standard fuse bulb, respectively.

In a preferred embodiment thereof, the interior of the non-standard fuse bulb socket is sized differently in at least one dimension than the interior of the standard bulb sockets such that the non-standard fuse bulb socket cannot operatively receive a standard bulb and/or the interior of the fuse bulb socket is at least temporarily deformed in at least one dimension by insertion of a fuse bulb therein such that the fuse bulb cannot thereafter be removed from the fuse bulb socket. Preferably, the non-standard fuse bulb socket interior is smaller in the at least one dimension than the standard bulb. Thus, the twinkle light set comprises, for at least one electrical circuit including at least one conventional twinkle bulb, alternately from one end of the circuit to an opposite end of the circuit, a single non-standard fuse bulb socket operatively receiving a fuse bulb and a plurality of standard bulb sockets, each of the latter operatively receiving a standard bulb, whether a conventional steady burning bulb or a conventional twinkle bulb.

The present invention extends to a combination of the twinkle light set, a non-standard fuse bulb and a plurality of standard bulbs including at least one conventional twinkle bulb. The exterior of each of the standard bulbs is sized differently in at least one dimension than the exterior of the non-standard fuse bulb such that the non-standard fuse bulb socket cannot operatively receive a standard bulb. Preferably, the standard bulbs are greater in the at least one dimension than the non-standard fuse bulb and/or the interior of the fuse bulb socket is at least temporarily deformed in at least one dimension by insertion of the fuse bulb therein such that the fuse bulb cannot thereafter be removed from the fuse bulb socket.

A third preferred embodiment of the present invention encompasses a fuse bulb twinkle light set comprising, for at least one electrical circuit including at least one non-standard twinkle bulb, a single fuse bulb socket operatively receiving a fuse bulb, a plurality of standard bulb sockets each operatively receiving a standard conventional steady burning bulb, and a plurality of non-standard bulb sockets, each of the latter operatively receiving a non-standard twinkle bulb. The standard bulb sockets, the non-standard bulb sockets, and the fuse bulb socket are configured and dimensioned to operatively receive only standard bulbs, non-standard twinkle bulbs and a fuse bulb, respectively.

Preferably the standard bulb sockets and the non-standard bulb sockets are configured and dimensioned to releasably operatively receive only standard steady burning bulbs and non-standard twinkle bulbs, respectively, and the fuse bulb socket is configured and dimensioned to non-releasably operatively receive only a fuse bulb.

In a preferred embodiment thereof, the interior of the fuse bulb socket is sized differently in at least one dimension than the interior of the standard and non-standard bulb sockets such that the fuse bulb socket cannot operatively receive a standard or non-standard bulb, and/or the interior of the fuse bulb socket is at least temporarily deformed in at least one dimension by insertion of a fuse bulb therein such that the fuse bulb cannot thereafter be removed from the fuse bulb socket. Preferably the fuse bulb socket interior is smaller in the at least one dimension than the standard or non-standard bulb. Thus, the twinkle light set comprises, for at least one electrical circuit, alternately from one end of the circuit to an opposite end of the circuit, a single fuse bulb socket operatively receiving a fuse bulb, at least one standard bulb socket operatively receiving a standard conventional steady burning bulb, and at least one non-standard bulb socket operatively receiving a non-standard twinkle bulb.

The present invention extends to a combination of the twinkle light set, a fuse bulb, a plurality of standard bulbs and a plurality of non-standard twinkle bulbs. The exterior of each of the standard and non-standard bulbs is sized differently in at least one dimension than the exterior of the fuse bulb such that the fuse bulb socket cannot operatively receive a standard or non-standard bulb, and/or the interior of the fuse bulb socket is at least temporarily deformed in at least one dimension by insertion of the fuse bulb therein such that the fuse bulb cannot thereafter be removed from the fuse bulb socket. Preferably the standard and non-standard bulbs are greater in the at least one dimension than the fuse bulb.

In a variant of the third preferred embodiment of the light set, each of the sockets operatively receives a non-standard twinkle bulb or a standard steady burning bulb. Preferably the standard bulb sockets are configured and dimensioned to releasably operatively receive only standard steady burning bulbs, the non-standard bulb sockets are configured and dimensioned to releasably operatively receive only standard steady burning bulbs and non-standard twinkle bulbs, and the fuse bulb socket is configured and dimensioned to non-releasably operatively receive only a fuse bulb.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 6 is a top plan view of another embodiment of a fuse bulb in a fuse bulb socket;

FIG. 7 is a sectional view thereof taken along the line 7—7 of FIG. 6;

DETAILED DESCRIPTION OF THE PREFERRED EMBODIMENTS

Figure 1:
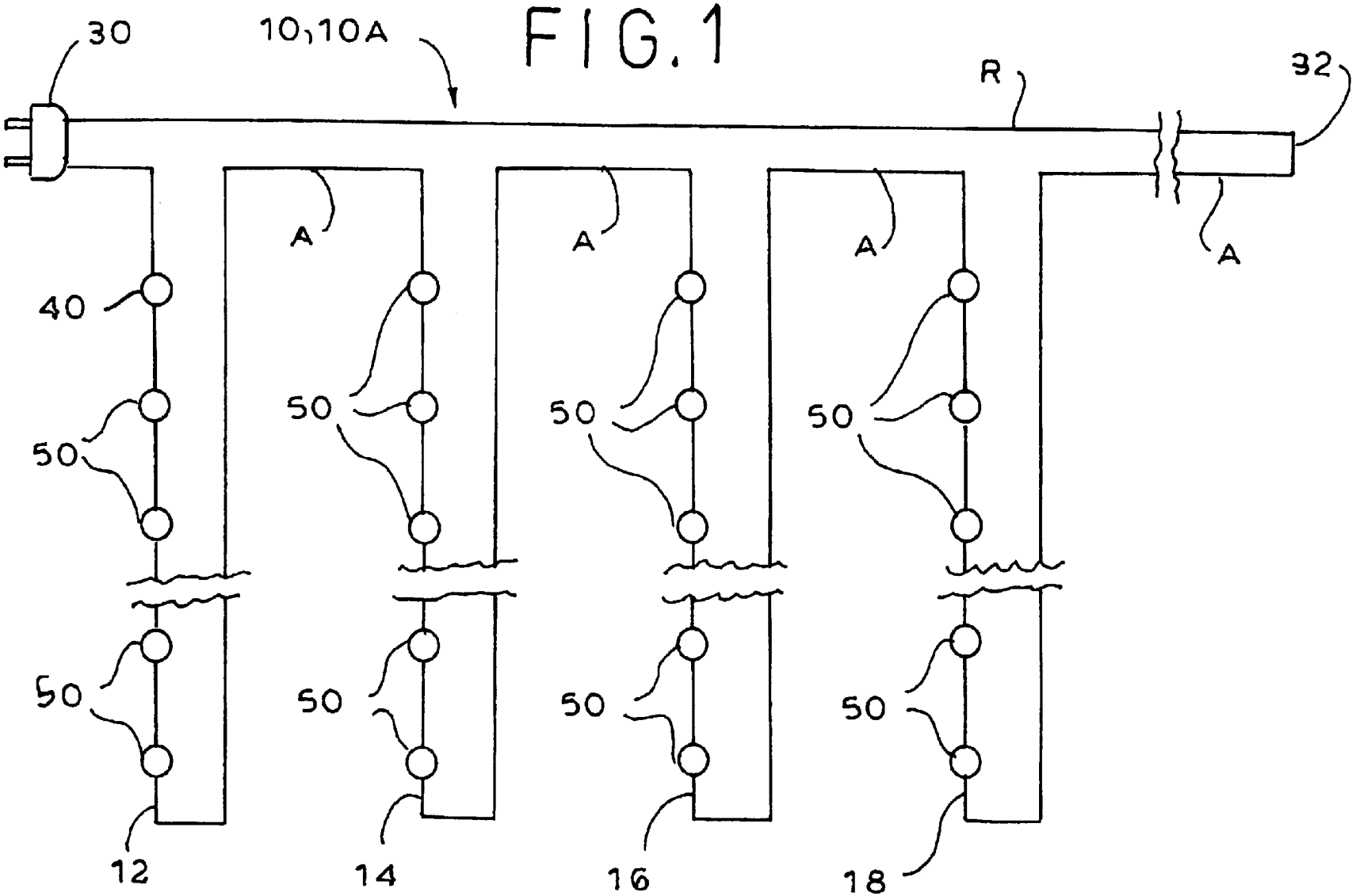
FIG. 1 is a fragmentary schematic view of a first preferred embodiment of a twinkle light set according to the present invention.

Referring now to the drawing, and in particular to FIG. 1 thereof, therein illustrated is a twinkle light set according to the present invention, generally designated by the reference numeral 10. The illustrated light set 10 is an icicle light set wherein the various bulbs are disposed in series on light strings. Each light string depends from a horizontally extending active segment wire A (as illustrated) or return wire segment R. While the illustrated light set involves a standard icicle or light string 12, followed by a twinkle light string 14, followed by another standard light string 16, followed by another twinkle light string 18, clearly different icicle light set patterns may be used; for example, each standard light string 12, 16 may be replaced by more than one standard light string and each twinkle light string 14, 18 may be replaced by more than one twinkle light string. Thus, a group or string set of standard bulb light strings 12, 16 may alternate with a group or set of twinkle bulb light strings 14, 18 or standard and twinkle bulb sockets may alternate along the length of a given light string. Indeed, as will be appreciated by those skilled in the art, the twinkle light set 10 according to the present invention need not be in the form of an icicle light set, and may instead be a net or mesh light set, a patterned light set (for example, forming diamonds rather than rectangles) or the like. The nodes or connections between adjacent light strings may be formed either at the lamp sockets or at the wires connecting the lamp sockets of each light string.

Each standard or twinkle light string 12–18 is formed by an active wire segment A or return wire segment R. Clearly, the height of each light string 12–18, may be varied to incorporate the desired number of bulbs per light string and the number of light strings in a given light set may be varied to provide a desired number of bulbs in a light set.

Referring still to FIG. 1, in order to preclude the user from modifying the light set 10 after purchase so that it is no longer safe, and to ensure that it remains in compliance with the safety goals of the UL standards, in the first preferred embodiment of the present invention illustrated in FIG. 1, the light set 10A comprises, alternately from one end 30 of the light set 10 to an opposite end 32 of the light set 10A, (a) a fuse bulb socket 40 non-releasably operatively receiving a fuse bulb 42, and (b) a plurality of standard bulb sockets 50, each releasably operatively receiving a standard bulb 51, whether that standard bulb is a conventional steady burning bulb or a conventional twinkle bulb. At least one of these standard sockets 50 is in operative receipt of a conventional steady burning bulb, and at least another of the standard bulb sockets 50 is in operative receipt of a conventional twinkle bulb. The outer configuration and dimensions of the fuse bulb socket 40 may be identical to those of the standard bulb sockets 50.

Figure 3:
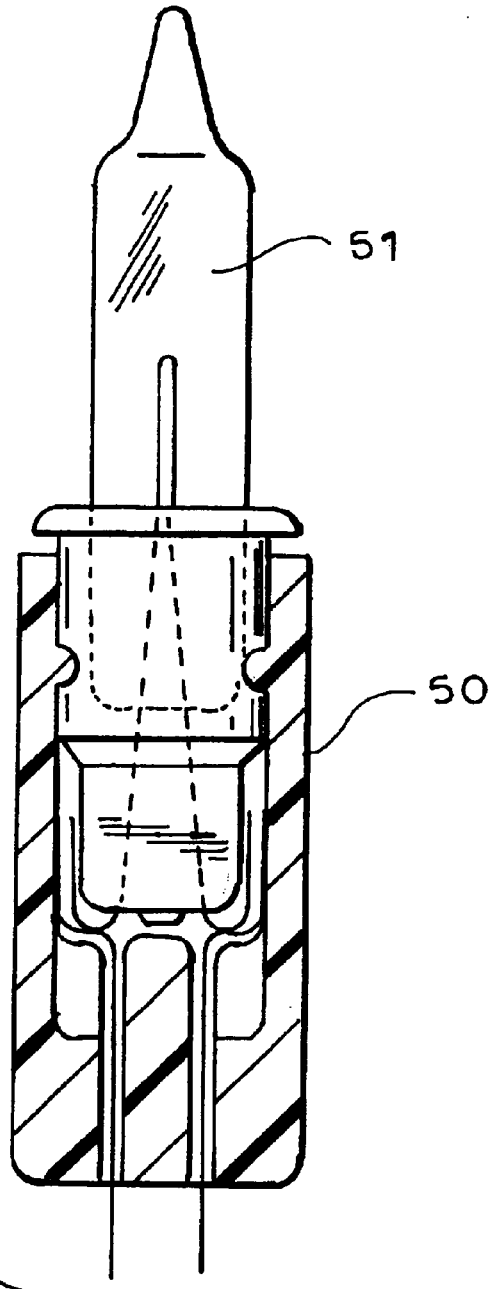
FIG. 3 is a sectional view thereof taken along the line 3—3 of FIG. 2.
Figure 2:
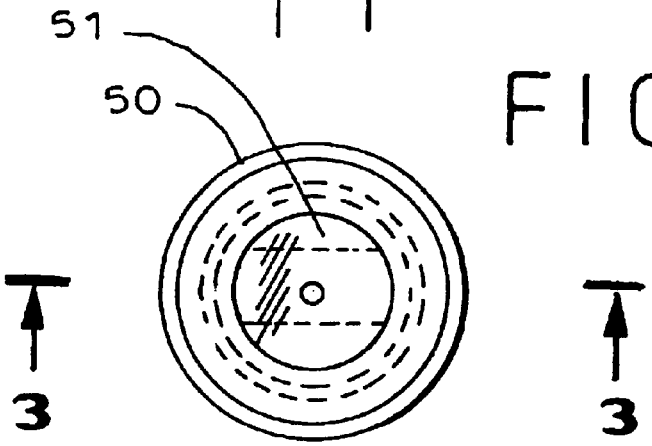
FIG. 2 is a top plan view of a standard bulb in a standard bulb socket.

Referring now to FIGS. 2 and 3, therein illustrated is the standard bulb socket 50 releasably operatively receiving a standard bulb 51, whether it be a conventional steady burning bulb or a conventional twinkle bulb.

Referring now to FIGS. 4–9, in order to ensure that the consumer cannot remove the fuse bulb 42 from the fuse bulb socket 40, the fuse bulb socket 40 is configured and dimensioned to non-releasably operatively receive the fuse bulb 42.

Figure 5:
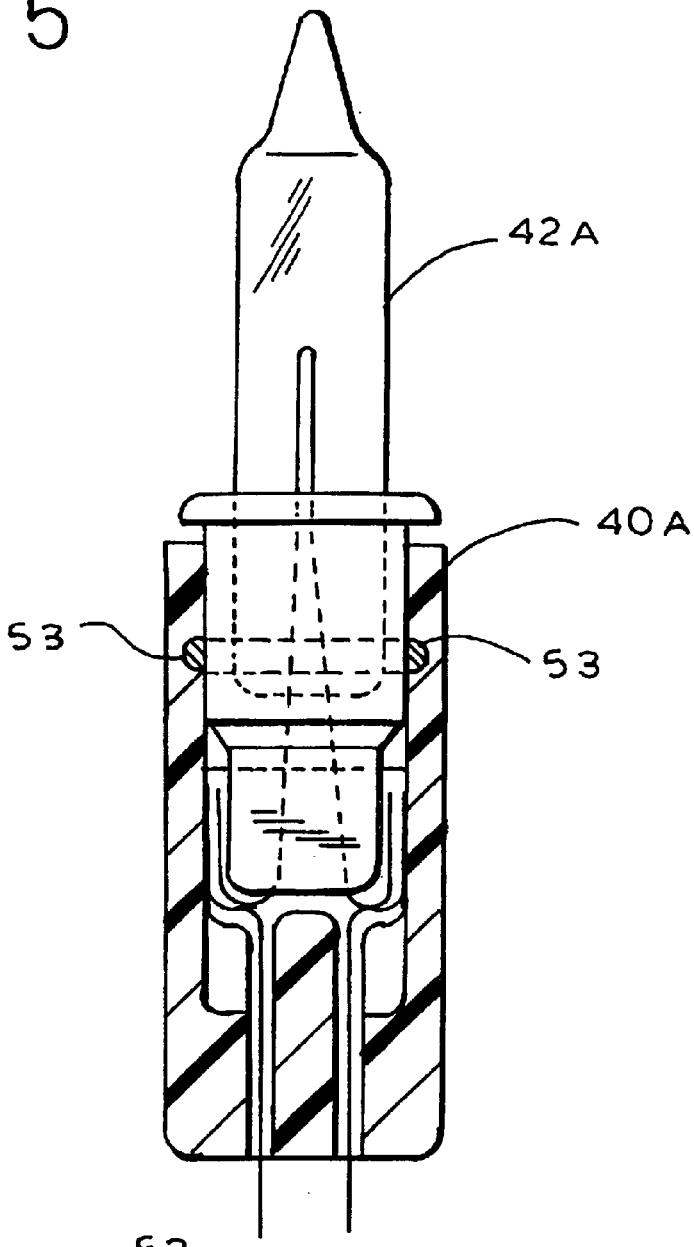
FIG. 5 is a sectional view thereof taken along the line 5—5 of FIG. 4.
Figure 4:
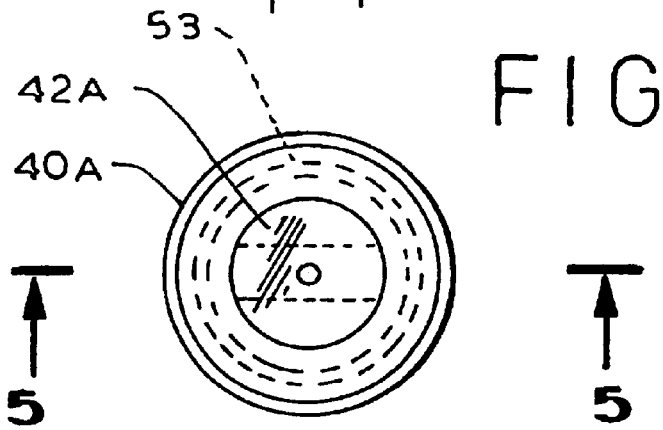
FIG. 4 is a top plan view of one embodiment of a fuse bulb in a fuse bulb socket.

Referring now to FIGS. 4 and 5, the fuse bulb 42A and the fuse bulb socket 40A may be secured together by an adhesive 53 of sufficient strength The adhesive 53 may be of any variety compatible with the interior of socket 40A and the base of the fuse bulb 42A—for example, a pressure-sensitive adhesive, a hot-melt adhesive, or the like. Indeed, the adhesive 53 need not be a separate third element, but may simply be a mixture of the aforementioned elements (i.e., the socket interior and the fuse bulb base) created by sonic welding or the like from the interface of the aforementioned two elements. While the adhesive 53 is illustrated in FIG. 5 as being disposed intermediate the bottom of the base of fuse bulb 42A and the top of the socket 40A, it may alternatively or additionally be disposed along the interior of the socket 40A and the exterior of the base of the fuse bulb 42A.

Referring now to FIGS. 6 and 7, alternatively the fuse bulb socket 40B and the base of fuse bulb 42B may be integrally molded together (e.g., along mold line 54) to provide an integral, one-piece, unitary construction formed in a single molding operation.

Figure 9:
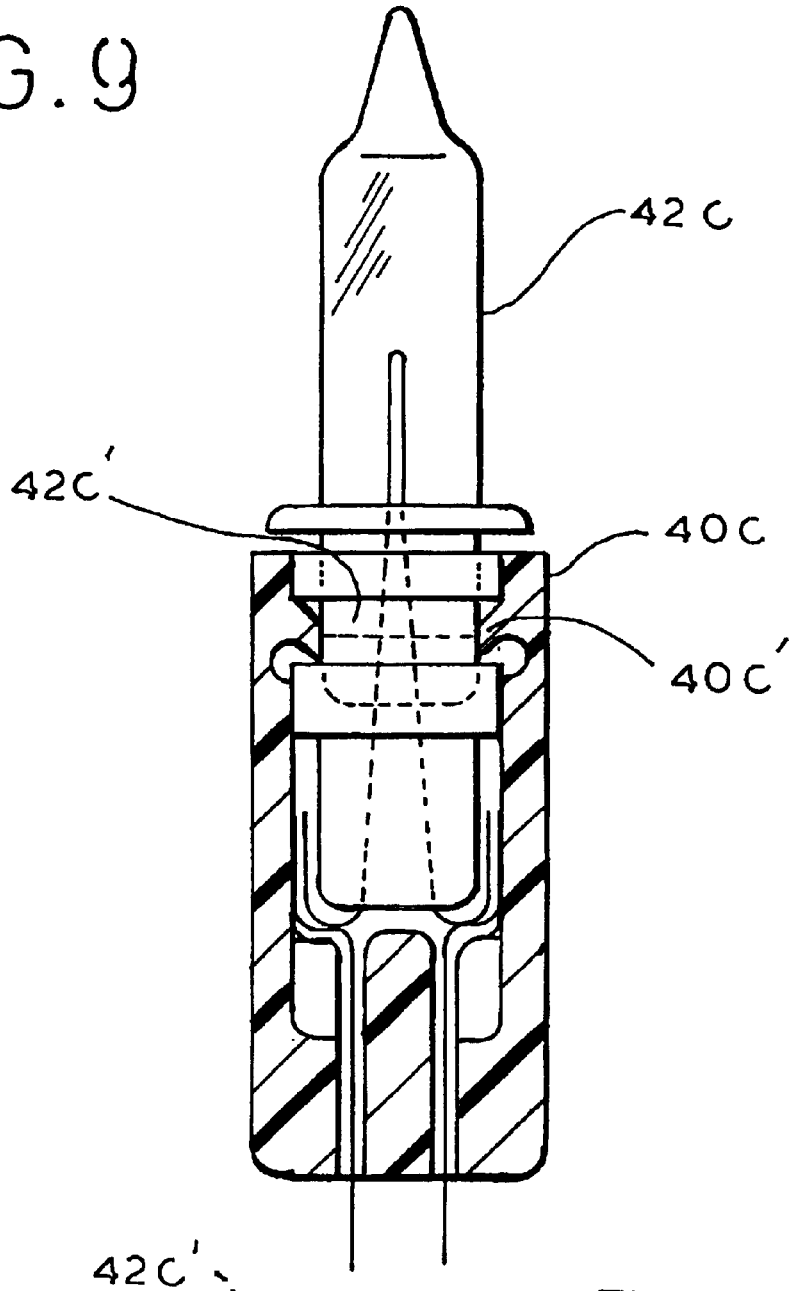
FIG. 9 is a sectional view thereof taken along the line 9—9 of FIG. 8.
Figure 8:
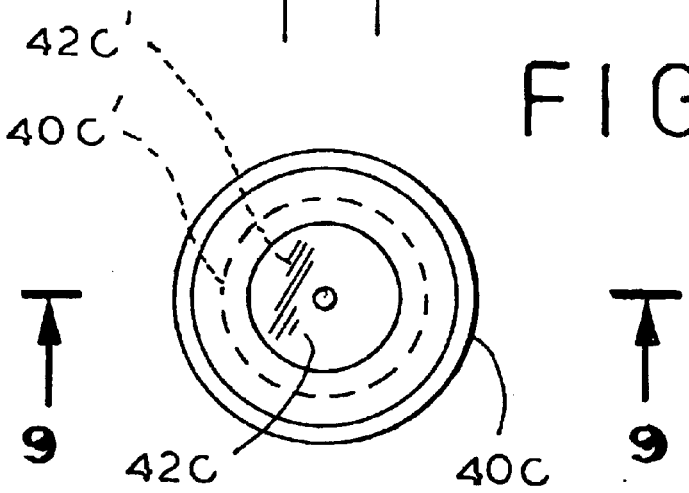
FIG. 8 is a top plan view of a further embodiment of a fuse bulb in a fuse bulb socket.
Figure 9A:
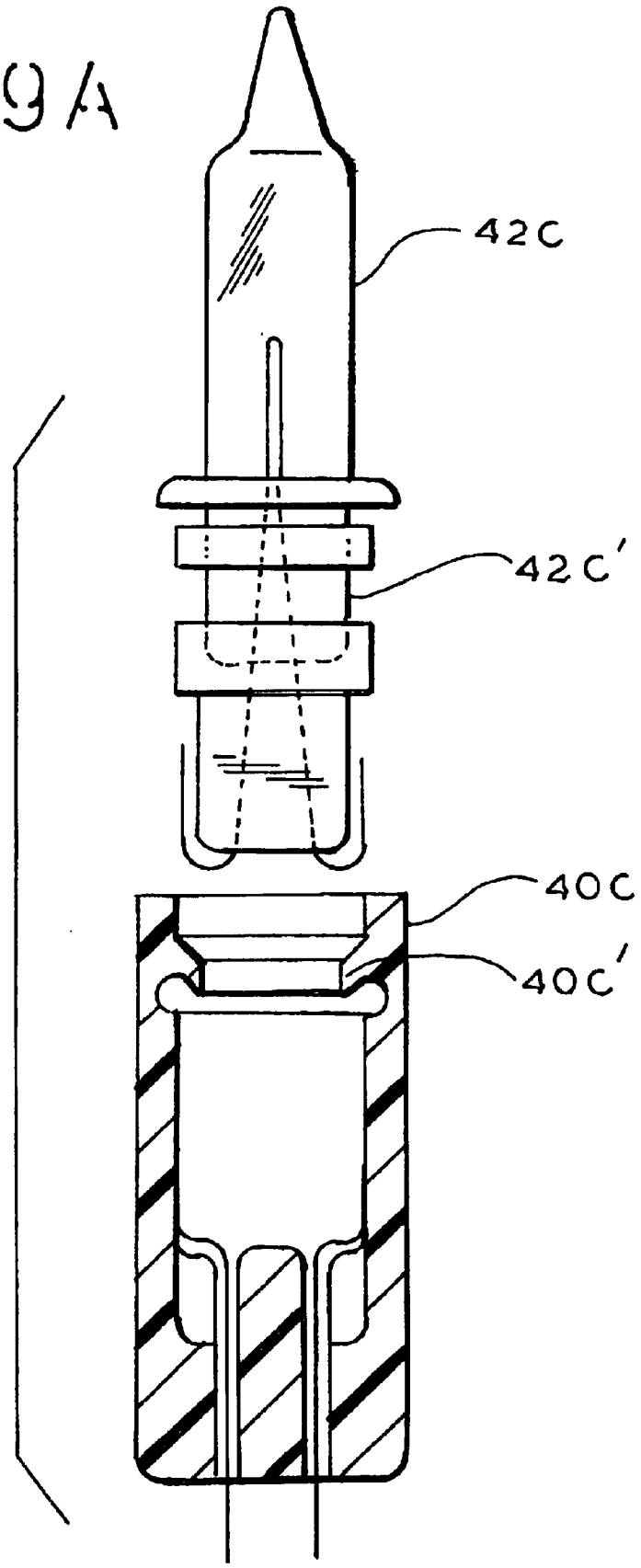
FIG. 9A is an exploded view thereof.

Referring now to FIGS. 8, 9 and 9A, alternatively the fuse bulb socket 40C may be configured and dimensioned to define at least resiliently one deformable projection 40C' which is relatively easily deformable in one direction for receipt within a mating recess 42C' of the base of fuse bulb 42C (during insertion of the base of fuse bulb 42C into the fuse bulb socket 40C), but is essentially non-deformable in the opposite direction (during attempted withdrawal of the base of the fuse bulb 42C from the fuse bulb socket 40C). The elements 40C' and 42C' can extend circumferentially around the interior of fuse bulb socket 40C and the exterior of the base of fuse bulb 42C, respectively, as illustrated, or can each be composed of one or more discrete mini-elements adapted to mate. Preferably the projection and recess are spaced substantially below the upper surfaces of both the fuse bulb socket 40C and the base of fuse bulb 42C. While the deformable projection 40C' may be disposed alternatively on an upper surface of the socket 40C, this is less desirable, as it leaves the deformable projection 40C' exposed such that a determined consumer can utilize appropriate tools for forcing deformation of the element 40C' and thereby enabling removal of the fuse bulb 42C from the fuse bulb socket 40C.

Clearly the same principles apply if the resiliently deformable projection is defined by the base of the fuse bulb 42C and the recess is defined by the fuse bulb socket 40C. Indeed, other techniques well known in the mechanical arts may be used to ensure non-releasable mating of the bulb base and bulb socket without departing from the principles of the present invention.

In each case, (e.g., FIGS. 4 and 5, 6 and 7, or 8 and 9), the light set 10A would come with the fuse bulb 42A, 42B, 42C already non-releasably operatively received in the fuse bulb socket 40A, 40B, 40C, respectively.

Figure 10:
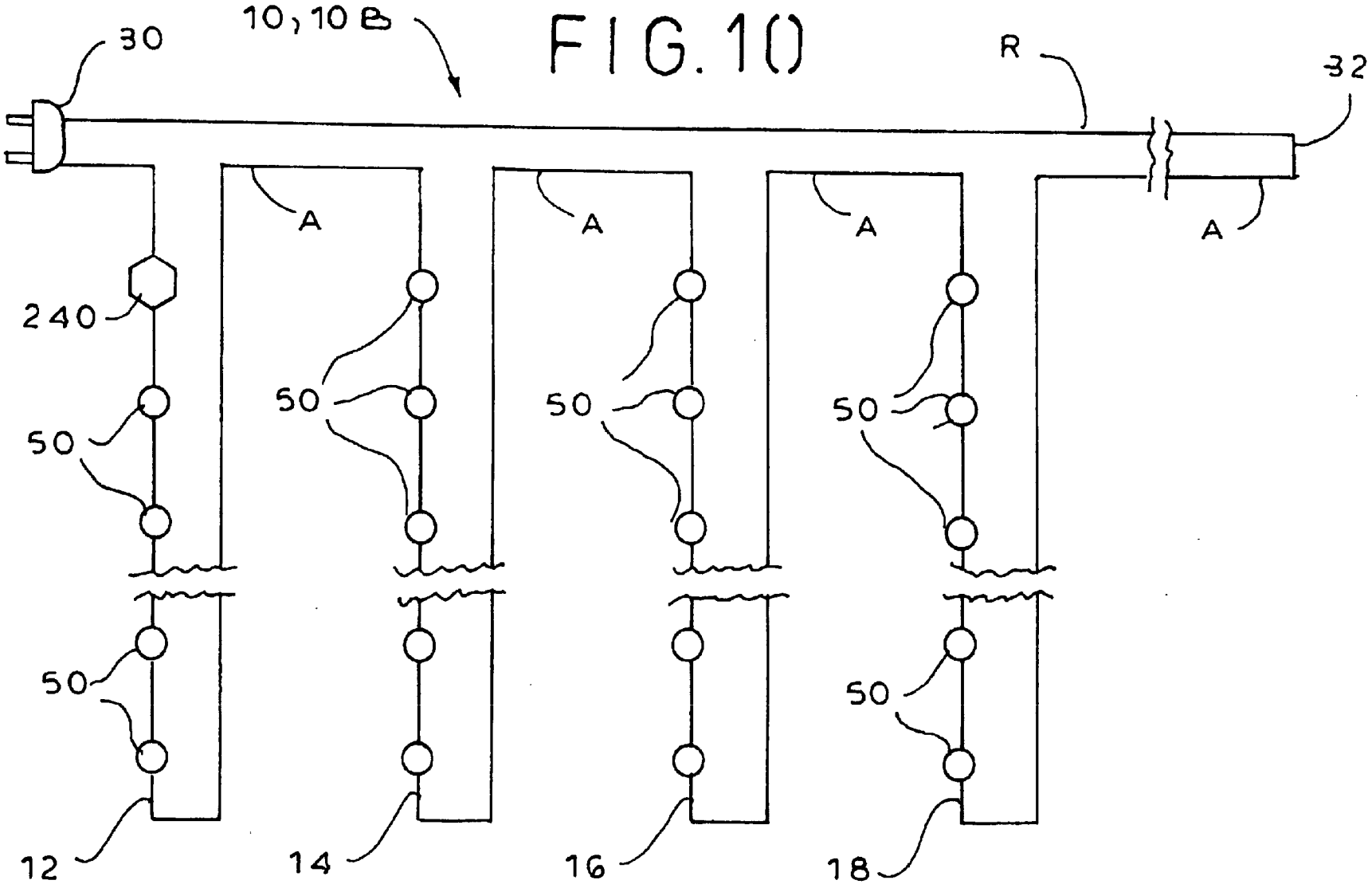
FIG. 10 is a fragmentary schematic view of a second preferred embodiment of a twinkle light set according to the present invention having a fuse bulb socket and a plurality of standard sockets for standard steady burning bulbs and standard twinkle bulbs.

In order to preclude the user from modifying the light set 10 after purchase by substitution of a standard steady burning bulb or a standard twinkle bulb so that the light set is no longer safe, and to ensure that the light set achieves the safety objectives of the UL, in the second preferred embodiment of the present invention illustrated in FIG. 10, the light set 10B comprises, alternately from one end 30 of the light set 10B to an opposite end 32 of the light set 10B, (a) a fuse bulb socket 240, and (b) a plurality of standard bulb sockets 250. The fuse bulb socket 240 is configured and dimensioned to operatively receive only the base portion of a fuse bulb 242, while each of the plurality of standard bulb sockets 250 is configured and dimensioned to operatively receive the base portion of a standard bulb 51, whether a conventional steady burning bulb or a conventional twinkle bulb. As will be apparent the comparison of FIGS. 1 and 10, the light set 10A and 10B differ only in the fuse bulb sockets 40, 240. Whereas in the light set 10A of the first preferred embodiment the fuse bulb 42 is not removable from the fuse bulb socket 40, in the light set 10B of the second embodiment the fuse bulb 242 is removable from the fuse bulb socket 240.

Figure 12:
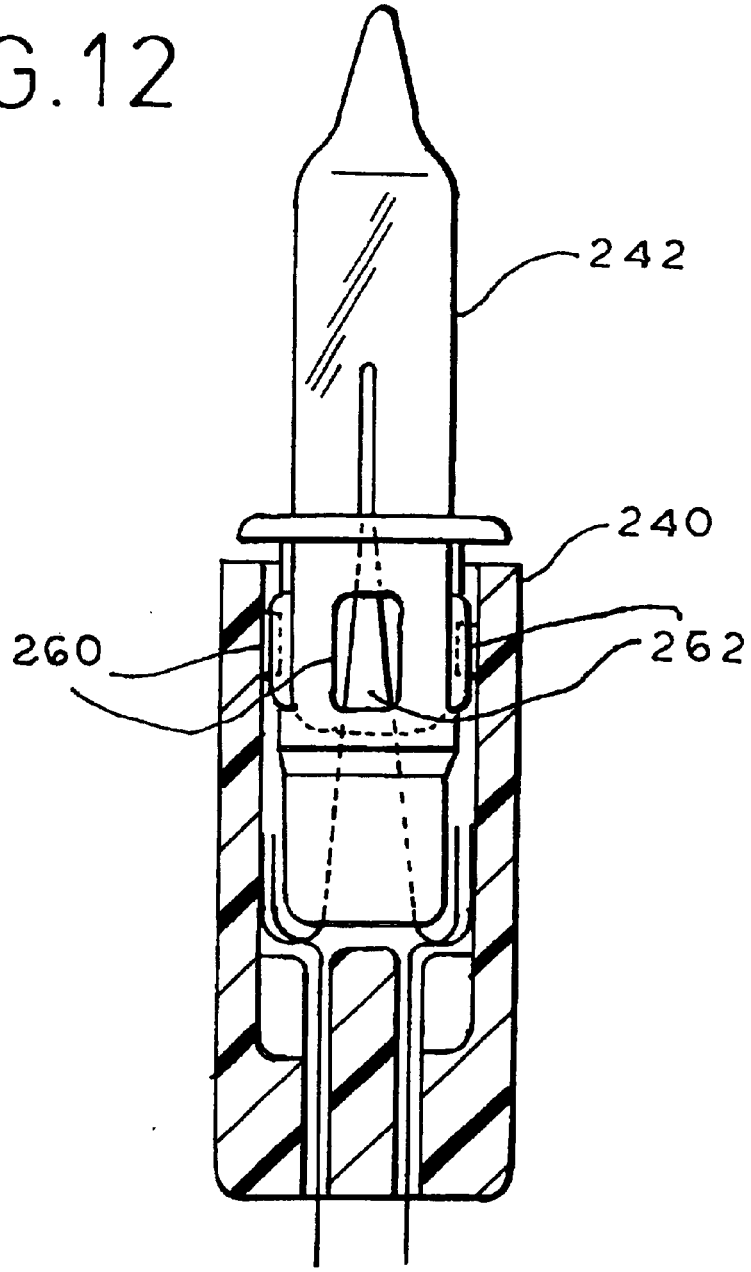
FIG. 12 is a sectional view taken along the line 12—12 of FIG. 11.
Figure 11:
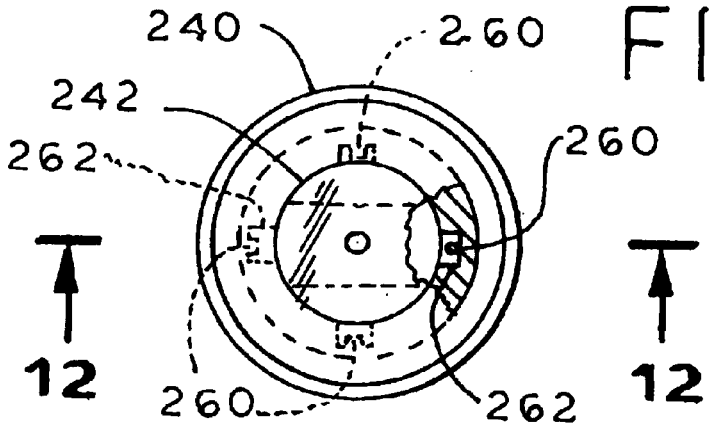
FIG. 11 is a top plan view of a one embodiment of a fuse bulb in a fuse bulb socket.

Precisely because of this difference, in the light set 10B it is necessary to ensure that the fuse bulb socket 240 operatively receives only a fuse bulb 242. Accordingly, the interior of the fuse bulb socket 240 is sized differently than the interior of the standard bulb socket 250 such that the fuse bulb socket 240 cannot operatively receive therein a standard bulb 51. For example, as illustrated in FIGS. 11 and 12, one of the fuse bulb socket 240 and the base of the fuse bulb 242 defines at least one key 260 while the other 242, 240 defines at least one mating keyway 262 such that the key(s) 260 precludes operative receipt therein of a standard bulb lacking the appropriate keyway(s) 262. As illustrated, the fuse bulb socket 240 defines four equidistantly spaced, radially inwardly extending keys 260 while the base of fuse bulb 242 defines four equidistantly spaced, radially outwardly extending keyways 262. Of course, the elements on which the mating key 260 and keyway 262 are disposed can be reversed and, indeed, each element (that is, the base of the fuse bulb and the fuse bulb socket) can have mating patterns of keys 260 and keyways 262 on each.

Figure 13:
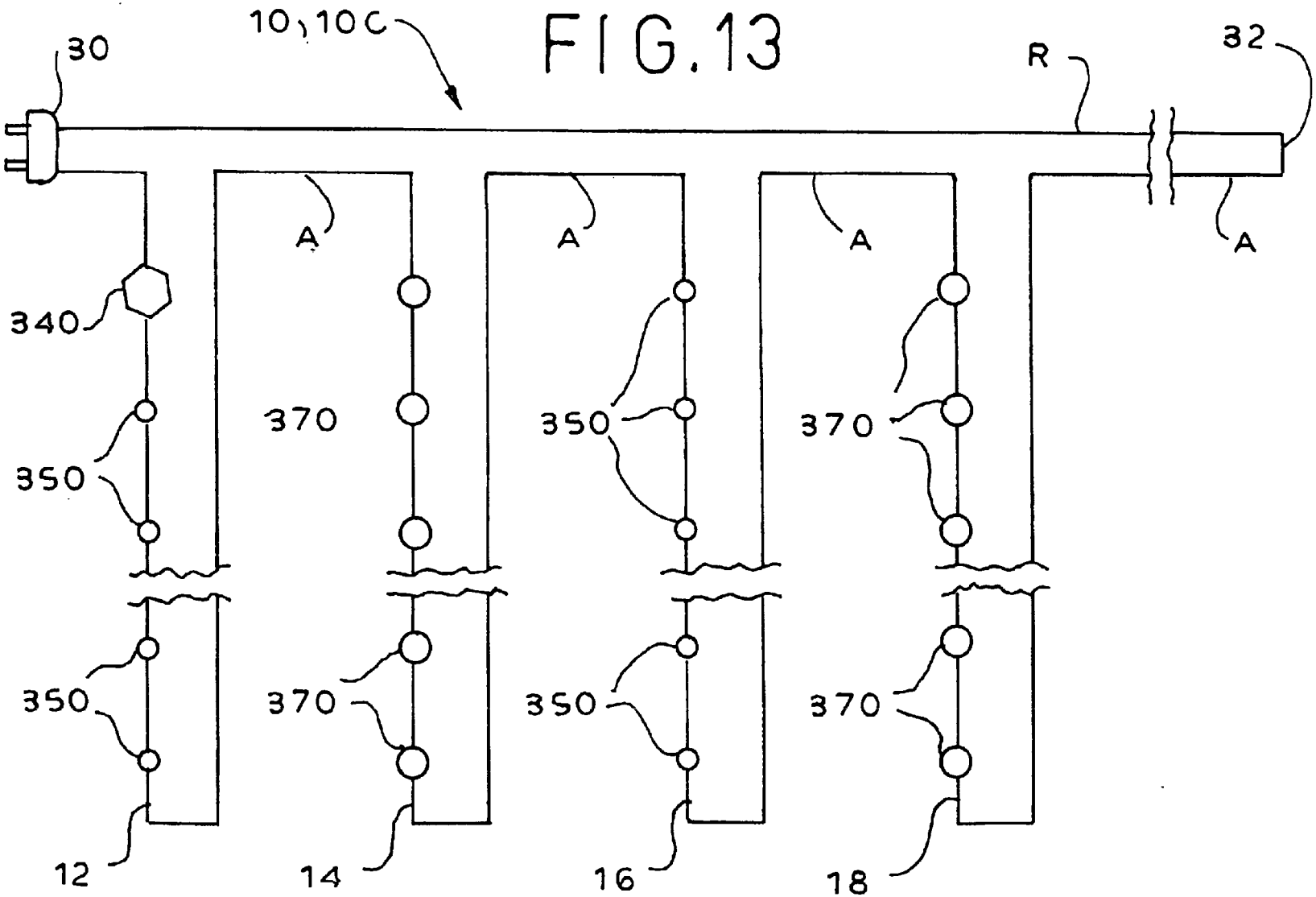
FIG. 13 is a fragmentary schematic view of a third preferred embodiment of a twinkle light set according to the present invention having a fuse bulb socket, smaller standard steady burning bulb sockets and larger non-standard twinkle bulb sockets.

Referring now to FIG. 13, in order to preclude the user from modifying the light set 10 after purchase so that the light set is no longer safe, and to ensure that the light set remains in compliance with UL standards, in the third preferred embodiment of the present invention illustrated in FIG. 13 the light set 10C comprises, alternately from one end 30 of the light set 10C to an opposite end 32 of the light set 10C, (a) a fuse bulb socket 340, (b) at least one standard bulb socket 350, and (c) at least one non-standard bulb socket 370, without regard to sequential order. The single fuse bulb socket 340 is configured and dimensioned to operatively receive the base portion of a fuse bulb 242. Each of the plurality of standard bulb sockets 350 is configured and dimensioned to operatively receive only the base portion of a standard conventional steady burning bulb 51, while each of the plurality of non-standard bulb sockets 370 is configured and dimensioned to operatively receive only the base portion of a non-standard twinkle bulb 372 (and optionally also the base portion of a standard steady burning bulb 51).

Figure 15:
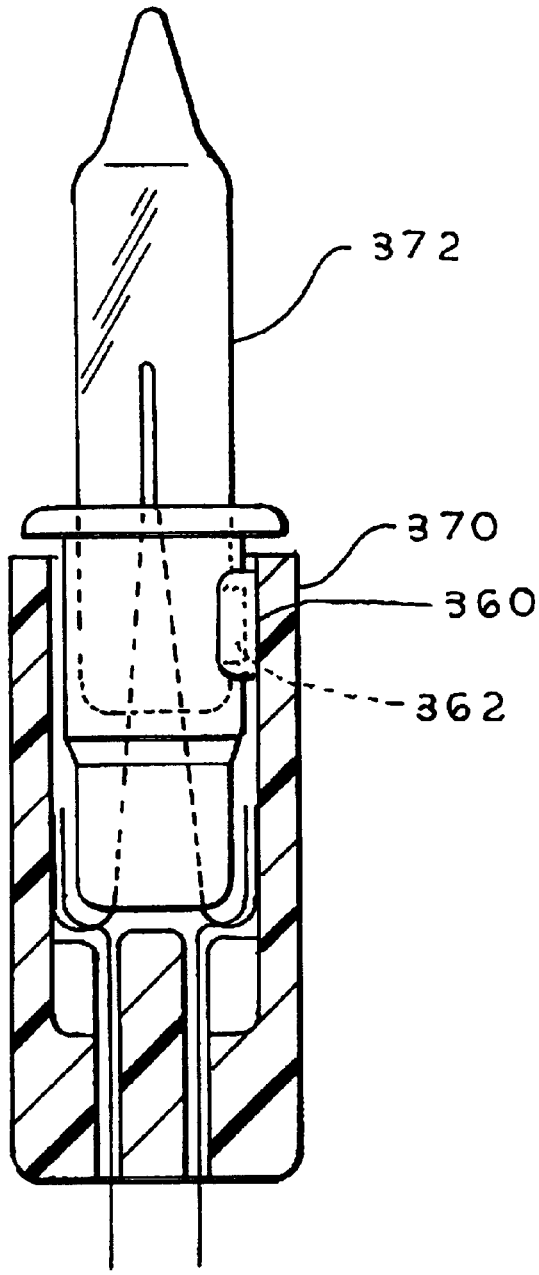
FIG. 15 is a sectional view thereof taken along the line 15—15 of FIG. 14.
Figure 14:
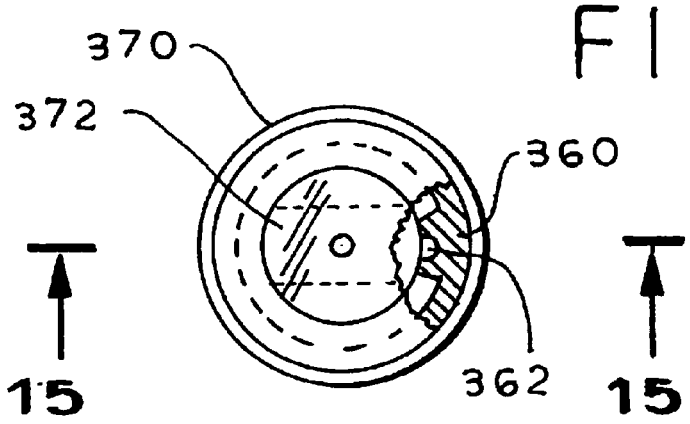
FIG. 14 is a top plan view of one embodiment of a non-standard twinkle bulb in a non-standard twinkle bulb socket.
Figure 17:
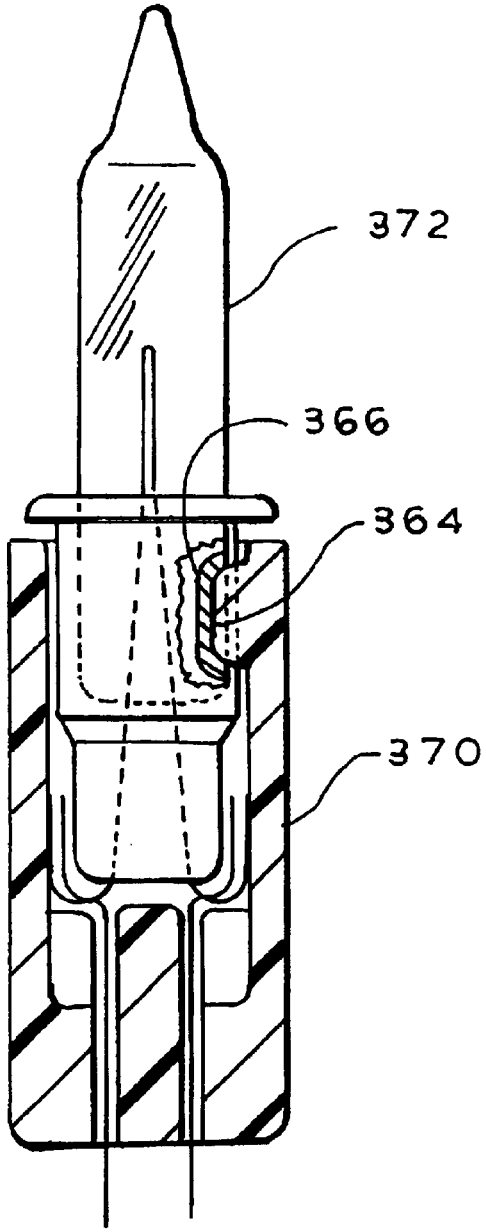
FIG. 17 is a sectional view thereof taken along the line 17—17 of FIG. 16.
Figure 16:
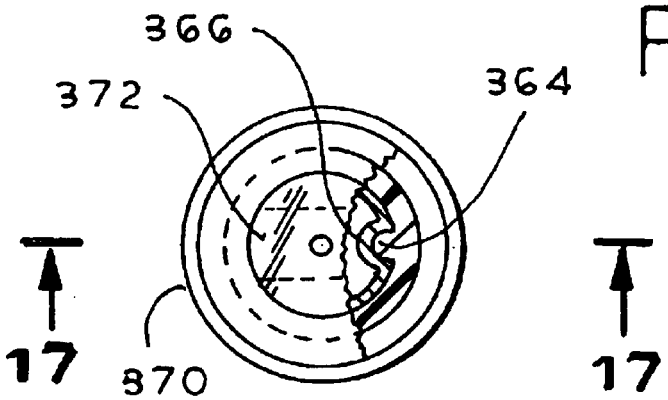
FIG. 16 is a top plan view of another embodiment of a non-standard twinkle bulb in another non-standard twinkle bulb socket.

The last requirement may be achieved through a variety of different mechanisms. Preferably the interior of the standard bulb socket 350 is sized differently (as illustrated, smaller) than the interior of the non-standard bulb socket 370 such that the standard bulb socket 350 cannot operatively receive therein a non-standard bulb 372. Alternatively, the interiors of each of the standard bulb sockets 350 may be greater than the exterior of each of the non-standard bulbs 372. Thus, as illustrated in FIGS. 14 and 15, a twinkle light set 10C may be used with a plurality of standard steady burning bulbs 51 and a plurality of non-standard twinkle bulbs 372 wherein each of the non-standard twine bulbs 372 has at least one exterior dimension sized differently (as illustrated, greater) than that of each of the standard steady burning bulbs 51, so as to preclude operative receipt of a non-standard twinkle bulb 372 in the interior of a standard bulb socket 350. Alternatively, and optionally, as illustrated in FIGS. 16 and 17, each of the non-standard twinkle bulbs 372 may have at least one exterior dimension smaller than that of each of the standard bulbs 51 so that the non-standard socket 370 cannot operatively receive therein a standard steady burning bulb 51.

For example, as illustrated in FIGS. 14 and 15, the non-standard bulb socket 370 may define an interior surface having an outwardly projecting keyway 362 and the non-standard bulb twinkle 372 may define an exterior surface having an outwardly projecting mating key 360 such that the key 360 of the non-standard bulb twinkle 372 precludes operative receipt thereof in a standard bulb socket 350 lacking a corresponding keyway 362. Alternatively, as illustrated in FIGS. 16 and 17, the non-standard bulb socket 370 may define an interior surface having an inwardly projecting key 364 and the non-standard twinkle bulb 372 may define an exterior surface having an inwardly projecting mating keyway 366 such that the key 364 of the non-standard bulb socket 370 allows operative receipt of a non-standard twinkle bulb 372 therein, yet precludes operative receipt therein of a standard steady burning bulb 51 lacking the keyway 366 to receive the socket key 364. The object of such designs is to preclude the introduction of a non-standard twinkle bulb 372 into a standard bulb socket 350, for the sake of safety and to meet UL standards. The designs may or may not permit the introduction of a standard steady burning bulb 51 into a non-standard bulb socket 370, as such a substitution does not involve safety considerations or violate UL standards.

Preferably the interior of the standard bulb socket 350 is smaller in at least one dimension than the interior of the non-standard bulb socket 370, and the exterior of the non-standard bulb twinkle 372 is greater in such at least one dimension than the interior of the standard steady burning bulb 51.

Preferably, the non-standard bulb socket 370 defines a keyway 62, the non-standard twinkle bulb 372 defines a mating key 360, and the standard bulb socket 350 lacks a mating keyway, whereby a non-standard twinkle bulb 372 will not fit into a standard bulb socket 350.

It is a matter of choice whether or not the exteriors of the different types of bulb sockets—that Is, the standard bulb socket 350 and the non-standard bulb socket 370—are identical in configuration and dimensions (or even color) so long as the user cannot inadvertently or intentionally substitute a non-standard twinkle bulb 372 within an ordinary or standard light socket 350. However, if desired, some clearly visible distinction (such as color or other indicia) may be used to signify to the user that a particular bulb socket is a non-standard bulb socket 370 designed for receipt of a non-standard twinkle bulb 372.

As earlier stated, the fuse bulb socket 340 is configured and dimensioned to receive a fuse bulb. As described in connection with the first embodiment light set 10A, the fuse bulb socket 340 (like fuse bulb socket 40) can be configured and dimensioned to non releasably operatively receive a fuse bulb (like fuse bulb 42—for example, the fuse bulb and the fuse bulb socket may be secured together by an adhesive, may be integrally molded together, or the socket interior may be temporarily deformed in at least one dimension by insertion of a fuse bulb therein such that the fuse bulb cannot thereafter be removed from the fuse bulb socket. Alternatively, as described in connection with the second embodiment light set 10B, the fuse bulb socket 340 (like fuse bulb socket 240) can be non-standardly configured and dimensioned to operatively receive only a non-standard fuse bulb like fuse bulb 242, so that a bulb other than a fuse bulb (for example, a steady burning bulb, a flasher bulb, or a twinkle bulb) cannot be operatively received in the non-standard fuse bulb socket 340.

It will be appreciated that the third embodiment (FIG. 13) affords the user two levels of protection. First, the presence of a fuse bulb in the circuit is essential if there is to be any current flow in the circuit, and that fuse bulb will blow or burn out if the current value exceeds a safe level. Second, the use of standard and non-standard sockets 350, 370 for the standard steady burning bulbs 51 and non-standard twinkle bulbs 372 allows the manufacturer to insure that only an appropriate number of twinkle bulbs 372 can be deployed in the circuit. The number of twinkle bulbs 372 is selected by the manufacturer to insure that the current will not exceed a safe level and, under ordinary circumstances, the differences between sockets 350 and 370 preclude the possibility of the substitution of twinkle bulbs 372 for standard steady burning bulbs 51 in the standard sockets 350.

While the user is thus afforded a double level of protection, it will be appreciated by those skilled in the art that the two protections differ not only in mechanism or function, but also in result. In the normal instance where a fuse bulb is non-releasably operatively secured in the fuse bulb socket, blowing of the fuse bulb by an excessive current requires a replacement of the entire electrical circuit (that is, the light set). While light sets are not overly expensive, this does represent an additional cost to the consumer who wishes to replace the light set, as well as the added bother of having to purchase another light set. By way of contrast, limiting the number of twinkle bulbs which may be used in the circuit (i.e., light set) Is intended to prevent the excessive current from developing in the first place, so that the fuse bulb will not have to blow out. In the event that a standard steady burning bulb has blown, the user must replace it with another standard steady burning bulb and cannot, either accidentally or intentionally, replace it with a non-standard twinkle bulb and thereby jeopardize the safety of the light set. Typically light sets are sold with spare steady burning bulbs and spare twinkle bulbs so that spares are immediately at hand to replace a burned out bulb, without incurring additional costs or inconvenience to the user.

The presence of a fuse bulb provides an extra level of protection which is not provided simply by limiting the number of twinkle bulbs in a circuit. Even if the number of twinkle bulbs in a circuit is kept below a specified number (for example, the number recommended by the UL), if a number of standard shunt-type steady-burning bulbs become blown or broken and are not replaced by the consumer, excessive current can still develop within the circuit because there are not enough operative steady burning bulbs to dissipate the excess current.

While the principles of the present invention have been explained above in terms of a standard steady burning bulb and a non-standard twinkle bulb, it is irrelevant for the purposes of the present invention whether the standard bulb is a steady burning bulb or a flasher bulb.

Furthermore, clearly a steady burning or flashing bulb may be operatively received into a twinkle bulb socket as this presents no safety hazard.

While the fuse bulb socket 40, 240, 340 has been illustrated in FIGS. 1, 10, 13, respectively, as the first bulb in the first light string 12, it will be appreciated that there may be more than one fuse bulb in any embodiment of the light set and that it may be placed anywhere along the circuit (although placing it at one end or the other or both makes it easier to find the fuse bulb socket).

To summarize, the present invention provides a twinkle light set which in one preferred embodiment meets the safety objectives of the UL standards, and in particular Section 588 thereof, without regard to relative number of standard and twinkle bulbs in an electrical circuit. In another preferred embodiment, the non-standard fuse bulb socket operatively receives a non-standard fuse bulb and cannot operatively receive a standard bulb. A third embodiment of the present invention provides a twinkle light set which meets the safety objectives of the UL standards, and in particular Section 588 thereof, and provides dual levels of protection. The light set is simple and economical to manufacture, use, and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

I claim:

1. A fuse bulb twinkle light set comprising, for at least one electrical circuit including at least one conventional twinkle bulb:

(A) a single fuse bulb socket operatively receiving a fuse bulb; and (B) a plurality of standard bulb sockets, each operatively receiving a standard bulb, whether a conventional steady burning bulb or a conventional twinkle bulb;

said standard bulb sockets being configured and dimensioned to releasably operatively receive standard bulbs, and said fuse bulb socket being configured and dimensioned to non-releasably operatively receive a fuse bulb.

2. The light set of claim 1 wherein said fuse bulb socket is secured by an adhesive to a fuse bulb.

3. The light set of claim 1 wherein said fuse bulb socket is integrally molded to a fuse bulb.

4. The light set of claim 1 wherein the interior of said fuse bulb socket is at least temporarily deformed in at least one dimension by insertion of a fuse bulb therein such that the fuse bulb cannot thereafter be removed from said fuse bulb socket.

5. The light set of claim 4 wherein said fuse bulb socket interior is smaller in said at least one dimension than said standard bulb socket interior.

6. In combination, a twinkle light set of claim 1, a fuse bulb, and a plurality of standard bulbs including at least one conventional twinkle bulb, the exterior of each of said standard bulbs being sized differently in at least one dimension than the exterior of said fuse bulb such that said fuse bulb cannot be removed from said fuse bulb socket interior.

7. The combination of claim 6 wherein the interior of said fuse bulb socket is at least temporarily deformed in at least one dimension by insertion of said fuse bulb therein such that said fuse bulb cannot thereafter be removed from said fuse bulb socket.

8. The combination of claim 6 wherein said standard bulbs are smaller in said at least one dimension than said fuse bulb.

9. In combination, a twinkle light set, a fuse bulb, and a plurality of standard bulbs; said twinkle light set comprising, for at least one electrical circuit including at least one conventional twinkle bulb, alternately from one end of said circuit to an opposite end of said circuit: (a) a single fuse bulb socket non-releasably operatively receiving a fuse bulb, and (b) a plurality of standard bulb sockets each releasably operatively receiving a standard bulb, whether a conventional steady burning bulb or a conventional twinkle bulb.

10. The combination of claim 9 wherein said fuse bulb socket is secured by an adhesive to a fuse bulb.

11. The combination of claim 9 wherein said fuse bulb socket is integrally molded to a fuse bulb.

12. The combination of claim 9 wherein the interior of said fuse bulb socket is at least temporarily deformed in at least one dimension by insertion of said fuse bulb therein such that said fuse bulb cannot thereafter be removed from said fuse bulb socket.

13. A fuse bulb twinkle light set comprising, for at least one electrical circuit including at least one conventional twinkle bulb:

(A) a single non-standard fuse bulb socket operatively receiving a non-standard fuse bulb; and (B) a plurality of standard bulb sockets, each operatively receiving a standard bulb, whether a conventional steady burning bulb or a conventional twinkle bulb;

said standard bulb sockets and said non-standard fuse bulb socket being configured and dimensioned to operatively receive only standard bulbs and a non-standard fuse bulb, respectively.

14. The light set of claim 13 wherein the interior of said non-standard fuse bulb socket is sized differently in at least one dimension than the interior of said bulb sockets such that said non-standard fuse bulb socket cannot operatively receive a standard bulb.

15. The light set of claim 14 wherein said non-standard fuse bulb socket interior is smaller in said at least one dimension than said standard bulb.

16. The light set of claim 13 wherein the interior of said fuse bulb socket is at least temporarily deformed in at least one dimension by insertion of a fuse bulb therein such that the fuse bulb cannot thereafter be removed from said fuse bulb socket.

17. In combination, the twinkle light set of claim 13, a non-standard fuse bulb and a plurality of standard bulbs including at least one conventional twinkle bulb, the exterior of each of said standard bulbs being sized differently in at least one dimension than the exterior of said non-standard fuse bulb such that said non-standard fuse bulb socket cannot operatively receive a standard bulb.

18. The combination of claim 17 wherein said standard bulbs are greater in said at least one dimension than said non-standard fuse bulb.

19. The combination of claim 17 wherein the interior of said fuse bulb socket is at least temporarily deformed in at least one dimension by insertion of said fuse bulb therein such that said fuse bulb cannot thereafter be removed from said fuse bulb socket.

20. In combination, a twinkle light set, a non-standard fuse bulb, and a plurality of standard bulbs; said twinkle light set comprising, for at least one electrical circuit including at least one conventional twinkle bulb, alternately from one end of said circuit to an opposite end of said circuit: (a) a single non-standard fuse bulb socket operatively receiving a fuse bulb, and (b) a plurality of standard bulb sockets each operatively receiving a standard bulb, whether a conventional steady burning bulb or a conventional twinkle bulb.

21. The combination of claim 20 wherein the interior of said fuse bulb socket is at least temporarily deformed in at least one dimension by insertion of said fuse bulb therein such that said fuse bulb cannot thereafter be removed from said fuse bulb socket.

22. A fuse bulb twinkle light set comprising, for at least one electrical circuit including at least one non-standard twinkle bulb:

(A) a single fuse bulb socket operatively receiving a fuse bulb;

(B) a plurality of standard bulb sockets each operatively receiving a standard conventional steady burning bulb; and (C) a plurality of non-standard bulb sockets each operatively receiving a non-standard twinkle bulb;

said standard bulb sockets, said non-standard bulb sockets, and said fuse bulb socket being configured and dimensioned to operatively receive only standard bulbs, non-standard twinkle bulbs and a fuse bulb, respectively.

23. The light set of claim 22 wherein the interior of said fuse bulb socket is sized differently in at least one dimension than the interior of each of said standard and non-standard bulb sockets such that said fuse bulb socket cannot operatively receive a standard or non-standard bulb.

24. The light set of claim 22 wherein the interior of said fuse bulb socket is at least temporarily deformed in at least one dimension by insertion of a fuse bulb therein such that the fuse bulb cannot thereafter be removed from said fuse bulb socket.

25. The light set of claim 24 wherein said fuse bulb socket interior is smaller in said at least one dimension than said standard or non-standard bulb.

26. In combination, the twinkle light set of claim 22, a fuse bulb, a plurality of standard bulbs and a plurality of non-standard twinkle bulbs; the exterior of each of said standard and non-standard bulbs being sized differently in at least one dimension than the exterior of said fuse bulb such that said fuse bulb socket cannot operatively receive a standard or non-standard bulb.

27. The combination of claim 26 wherein the interior of said fuse bulb socket is at least temporarily deformed in at least one dimension by insertion of said fuse bulb therein such that said fuse bulb cannot thereafter be removed from said fuse bulb socket.

28. The combination of claim 26 wherein said standard and non-standard bulbs are greater in said at least one dimension than said fuse bulb.

29. The light set of claim 22 wherein said standard bulb sockets and said non-standard bulb sockets are configured and dimensioned to releasably operatively receive only standard bulbs and non-standard twinkle bulbs, respectively, and said fuse bulb socket is configured and dimensioned to non-releasably operatively receive only a fuse bulb.

30. The light set of claim 29 wherein said fuse bulb socket is secured by an adhesive to a fuse bulb.

31. The light set of claim 29 wherein said fuse bulb socket is integrally molded to a fuse bulb.

32. The light set of claim 29 wherein the interior of said fuse bulb socket is at least temporarily deformed in at least one dimension by insertion of a fuse bulb therein such that the fuse bulb cannot thereafter be removed from said fuse bulb socket.

33. In combination, a twinkle light set, a fuse bulb, a plurality of standard bulbs; and a plurality of non-standard twinkle bulbs; said twinkle light set comprising for at least one electrical circuit, alternately from one end of said circuit to an opposite end of said circuit: (a) a single fuse bulb socket operatively receiving a fuse bulb, (b) at least one standard bulb socket operatively receiving a standard conventional steady burning bulb, and (c) at least one non-standard bulb socket operatively receiving a non-standard twinkle bulb.

34. The combination of claim 33 wherein the interior of said fuse bulb socket is at least temporarily deformed in at least one dimension by insertion of said fuse bulb therein such that said fuse bulb cannot thereafter be removed from said fuse bulb socket.

35. A fuse bulb twinkle light set comprising, for at least one electrical circuit including at least one non-standard twinkle bulb:

(A) a single fuse bulb socket operatively receiving a fuse bulb;

(B) a plurality of standard bulb sockets each operatively receiving a standard conventional steady burning bulb; and (C) a plurality of non-standard bulb sockets each operatively receiving a non-standard twinkle bulb or a standard steady burning bulb;

said standard bulb sockets being configured and dimensioned to operatively receive only standard bulbs, said non-standard bulb sockets being configured and dimensioned to operatively receive only standard bulbs and non-standard twinkle bulbs, and said fuse bulb socket being configured and dimensioned to operatively receive only a fuse bulb.

36. The light set of claim 35 wherein said standard bulb sockets are configured and dimensioned to releasably operatively receive only standard bulbs, said non-standard bulb sockets are configured and dimensioned to releasably operatively receive only standard bulbs and non-standard twinkle bulbs, and said fuse bulb socket is configured and dimensioned to non-releasably operatively receive only a fuse bulb.

37. In combination, a twinkle light set, a fuse bulb, a plurality of standard bulbs, and a plurality of non-standard twinkle bulbs; said twinkle light set comprising for at least one electrical circuit, alternately from one end of said circuit to an opposite end of said circuit: (a) a single fuse bulb socket operatively receiving a fuse bulb, (b) at least one standard bulb socket operatively receiving a standard conventional steady burning bulb, and (c) at least one non-standard bulb socket operatively receiving a non-standard twinkle bulb or a standard conventional steady burning bulb.

* * * * *